United States Patent [19]

Johnsen

[11] Patent Number: 4,782,194

[45] Date of Patent: Nov. 1, 1988

[54] HIGH VOLTAGE MASS-IMPREGNATED POWER CABLE

[75] Inventor: John N. Johnsen, Oslo, Norway

[73] Assignee: Alcatel USA Corp., New York, N.Y.

[21] Appl. No.: 932,808

[22] Filed: Nov. 19, 1986

[30] Foreign Application Priority Data

Nov. 25, 1985 [NO] Norway ..... 854698
Oct. 1, 1986 [NO] Norway ..... 863905

[51] Int. Cl.[4] ..... H01B 7/18

[52] U.S. Cl. ..... 174/107; 174/23 R; 174/25 R; 174/106 R

[58] Field of Search ..... 174/107, 23 R, 23 C, 174/25 R, 25 C, 106 R, 108, 13

[56] References Cited

U.S. PATENT DOCUMENTS

| | | | |
|---|---|---|---|
| 1,900,600 | 3/1933 | Emanueli | 174/25 R |
| 2,290,698 | 7/1942 | Mollerhoj | 174/13 |
| 2,527,172 | 10/1950 | Beaver et al. | 174/106 R |
| 2,531,917 | 11/1950 | Mollerhoj et al. | 174/13 |
| 2,662,931 | 12/1953 | Mougey | 174/108 |
| 2,709,197 | 5/1955 | Davey | 174/25 R |
| 4,417,093 | 11/1983 | Occhini et al. | 174/25 R |

FOREIGN PATENT DOCUMENTS

| | | | |
|---|---|---|---|
| 2034875 | 1/1972 | Fed. Rep. of Germany . | |
| 2355482 | 5/1975 | Fed. Rep. of Germany | 174/13 |
| 2947082 | 5/1981 | Fed. Rep. of Germany | 174/23 R |
| 332177 | 7/1930 | United Kingdom | 174/106 R |
| 349415 | 5/1931 | United Kingdom | 174/106 R |

*Primary Examiner*—Morris H. Nimmo
*Attorney, Agent, or Firm*—Spencer & Frank

[57] ABSTRACT

A high voltage mass impregnated power cable to be used on land and in shallow waters by including in the cable construction a pressure body having a number of pressure tapes applied in several layers on a bedding between the metal sheath and the tapes. The pressure tapes have good elastic properties and may consist of high quality metal or a strong synthetic material and are applied with a short lay length. The pressure body maintains under all load conditions including no-load, an internal pressure on the cable insulation above atmospheric pressure and high enough to prevent creation of voids in the insulation.

19 Claims, 3 Drawing Sheets

HIGH VOLTAGE MASS-IMPREGNATED POWER CABLE

BACKGROUND OF THE INVENTION

The present invention relates to power cables of the mass-impregnated type, i.e., metal sheathed cables insulated with paper which is impregnated with a viscous compound (also called Solid Type Paper Insulated Cables), and is especially related to such cables designed for high voltage direct current (HVDC) transmission, underground as well as submarine in shallow waters.

Actually the mass-impregnated cable is the oldest type of high voltage cable. Already at the turn of the century, 85 years ago, such cables were in use for voltages up to 10 kV. Later the voltages increased thanks to improvements of the insulating materials as well as to development of the required production processes.

However, experience showed that the normal mass-impregnated cable has one important draw-back. In steep slopes of the cable route, the impregnant has a tendency to migrate from a higher level of the route to a lower one, with the result that the insulation of the cable at the higher level would get voids which could result in ionization and break down of the insulation. Such migration of the impregnant is accellerated when the temperature of the cable varies, for instance due to load variations. When the temperature increases, the impregnating compound will expand and press out the diameter of the metal sheath. When the cable is cooled again due to reduction or switching off of the load, the impregnant will contract. However, since the metal sheath material used, such as lead, is a rather soft and plastic material the expanded diameter of the sheath will mainly remain, and there will be a deficit of impregnating compound also at the lower level of the cable route giving room for additional migration from the higher level. The next time the cable is loaded, new expansion takes place and so on. Since the viscosity of the impregnating compound changes strongly with the temperature (reducing with increasing temperature), an increase of the maximum temperature will also contribute to accelleration of the migration. For these reactions limitations had to be introduced regarding the use and application of the mass-impregnated cable type. The rated AC voltage was limited to 60 kV and the maximum operating temperature was limited to 40°-70° C. depending on the rated voltage.

When higher voltages and higher transmission capacities were demanded, other cable types were developed, based on pressurization of the insulation (pressure higher than the atmospheric pressure, the so called pressure cables). Examples of such cables are the oil-filled types, the gas-pressure cables, etc. In such cables provisions are made to keep the pressure of the insulation at a minimum positive design pressure (which may be just above the atmospheric pressure or a high pressure of some 15 bar) in the entire cable length under all load conditions. These cables can be used for considerably higher voltages and temperatures than the normal mass-impregnated cables. For instance, selfcontained oil-filled cables have been designed for voltages up to 1100 kv AC and maximum temperatures of 85°-90° C. As a consequence, the mass-impregnated cable is generally not used for AC voltages above 20-30 kV.

Pressure cables are designed with continuous duct(s) in the cable communicating with degasified oil (oil-filled cables) or gas (gas-pressure cables) stored in tanks at certain places along the cable route. The pressure may be obtained in two ways: either by means of static pressure tanks or by means of pumping plants. Especially in connection with long HVDC submarine oil-filled cables (which are more used than gas-pressure cables—for reasons which are not discussed here) large quantities of oil are needed at the terminals of the cables to keep the pressure at the prescribed minimum level under all load conditions. Due to the dynamic pressures which are generated as the oil is flowing along the duct(s) to or from the oil tanks during heating and cooling respectively, the pressure at the terminals must be high. Since the pressure at the terminals must be limited (for mechanical reasons), this will contribute to limiting the length of an oil-filled cable. Another draw-back with the oil-filled cable type used as submarine cable is connected with the risk of failure of the cable, for instance due to anchoring, fishing tackle etc. If a failure occurs, the fluid impregnating oil will flow out of the cable at the failure spot, and since several days—some times several weeks—may pass before the failure can be repaired, large additional quantities of degasified oil are needed at the terminals to refill the cable, and there is always the risk that water will penetrate into and/or along the cable duct damaging a great part of the cable insulation and making the repair very difficult. However, as far as the insulating system is concerned, the oil-filled cable type may be designed for DC voltages up to at least 1000 kV when the cable route is otherwise adequate for the oil-filled cable type.

Gradually the market for mass-impregnated cables is also vanishing for the lower AC voltages up to 20-30 kV due to the development of plastic insulated cables. However, in connection with the introduction of high voltage direct current (HVDC) transmission of the mass-impregnated cable has met with a new era, especially for submarine transmission. There are several reasons for this:

- The cable type may be used as submarine cables in practically unlimited lengths (only limited by the voltage drop)
- The cable type may be designed for reasonably high DC voltages (the maximum voltage for cables in actual service today is slightly below 300 kV).
- The cable type is simple and robust compared with the pressure cables (simple cable design, simple repair if a failure should occur, the water will penetrate only a few meters along the cable). No large stores of oil or complicated pumping plants are needed at the end terminal(s); only one small static pressure tank filled with a compound compatible with the cable's impregnant is needed at each of the end-terminals mainly to keep the pressure of the end-terminal's insulation above the atmospheric pressure. Thanks to the viscous impregnant which acts as a lubricant of the paper-tapes the insulation endures rough mechanical handling of the cable.

However, the risk of migration of the impregnant in steep parts of the cable route causes a limitation as to the voltage for which it may be designed, also in the case of HVDC cables. The purpose of this invention is to overcome this draw-back by designing and manufacturing a mass-impregnated cable in such a way that it acts as a pressure cable under all load conditions.

It has been demonstrated by tests that the pressure of the insulation in a mass-impregnated submarine cable depends on the sea depth. At certain depths depending on the cable design, ambient temperature, load conditions etc. the pressure will always be higher than the atmospheric pressure and the pressure increases with increasing sea depth. This is due to the outer water pressure. At such depths the cable is operating as a pressure cable under all actual load conditions. Since the pressure of the insulation increases with increasing sea depths, no migration of the impregnant can take place in deep water from an upper level of the route to a lower one, regardless of the steepness of the route. The weak parts of a submarine mass-impregnated cable are therefore located to the shallow waters and the parts on land since in these parts of the cable route there may be a risk of migration of the impregnant of the cable insulation. "Shallow-waters" in this sense are waters with sea depths less than 50–200 m depending on cable design, ambient temperature, load conditions, etc.

It has been suggested that the mass-impregnated cable in the shallow parts of a route be replaced with oil-filled cable. However, if the shallow part of the route is very long (in some cases it may be several hundred km), an oil-filled cable cannot be used.

To overcome some of the said problems it has also been suggested that the mass-impregnated cable be provided with a pressure-body consisting of a number of elastic metal tapes applied edge to edge directly on the lead sheath, Swedish Pat. No. 115089.

A drawback of this design is that the tapes, which are applied in one layer on the lead sheath, must be applied with a relatively long lay-length, involving a poor utilization of the material since the tension of the tapes will have to be relatively high to obtain sufficient pressure of the tapes against the lead sheath during operation of the cable and therefore the tapes must be relatively thick in order not to exceed the yield strength of the tapes.

Further the application of the metal tapes edge to edge is hardly practical apart from the fact that when the tapes are laid edge to edge during application, they will not function as intended when the cable is colder than the temperature in the factory during application. Certainly, in a very short cable this drawback can be overcome by pressing impregnating mass into the cable after the application of the tapes as suggested in the patent. But from a practical point of view, this is not possible in a long cable since the time for such an operation would be far too long and uneconomical.

Another drawback with this design is the application of the tapes directly on the lead sheath. Due to the high tension of the tapes, the edges of the metal tapes will have a tendency to cause injury to the lead sheath, since lead is a very soft material. Such injury is accelerated when the cable is hot, partly because the lead gets softer, partly since the tension of the tapes will increase due to the expansion of the cable. Because of the cables expansion there will be a gap between the tapes even if they are applied with edge to edge during the manufacture and due to the internal pressure the soft lead will have a tendency to be pressed into these gaps, and in the long run this may result in cracks of the lead sheath at the edges of the tapes because of the relatively great thickness of the metal tapes.

SUMMARY OF THE INVENTION

The mass-impregnated cable of this invention—whether the cable is round or shaped (for instance, oval) and whether the insulating layers consist of cellulosic paper or synthetic paper or a composite paper consisting for instance of cellulosic paper(s) laminated with one or more film(s) of synthetic material—is designed and manufactured as a pressure cable suitable for transmission of high voltage (250 kV and above) electric power by applying a pressure body over the metal sheath consisting of two or more layers of thin elastic tapes, in the following called pressure tapes, applied with a short lay length on a bedding between the metal sheath and the pressure tapes. The pressure tapes should have good elastic properties and may consist of a high quality metal or a strong synthetic material. The number of layers of the pressure tapes must be at least two and the length of lay of the tapes should not be more than 1.5 times the diameter of the lead sheath. In a preferred embodiment of the invention the pressure body consists of four to eight layers of pressure tapes applied on the bedding with a lay length of 0.4 to 0.8 times the diameter of the lead sheath, the bedding consisting of copper-woven fabric tape(s), a tough plastic sheath or some other material suitable for the function as bedding layer. Depending upon the width of the tapes there should be one, maximum two, tapes in each layer and there should be positive gaps in the order of 0.2 to 2.0 mm between the side edges of the tapes in each layer. In the case of the bedding consisting of copper-woven fabric tapes the preferred embodiment may have a plastic jacket over the pressure tapes. The pressure tapes should be applied with tension sufficiently high to obtain a pressure of the insulation above the atmospheric pressure whether the cable is loaded or not and irrespective of the cable route. When increasing the load of a cable of this new type the expansion of the impregnant will expand the metal sheath as described above, and when the impregnant contracts due to cooling, the pressure body will compress the metal sheath to the "original" diameters so that the insulation will be kept under pressure all the time. Calculations based on tests have shown that this is possible.

The requirements to the elastic properties of the material of the pressure body depend on the cable design and the service conditions (temperatures, shape of the cable route etc.). Calculations have shown (see below) that the elastic elongation of pressure tapes should be at least $e=0.003$ (0.3%). The requirement will normally be $0.004<e<0.006$ (0.4–0.6%), but it may be as high as 0.009 and even more.

Materials which will meet such requirements are high quality steel, high quality bronze etc. However, this invention covers all materials—including synthetic materials such as fiber armored epoxy or similar—with elasticity properties which are satisfactory in the sense of being used as a pressure body for mass-impregnated pressure cables.

Normal cables do not have pressure bodies giving a desired insulation pressure at all times. In the case of pressure tapes, these will usually be applied with a tension which is far higher than that used for application of tapes in the normal cables, and the taping machinery must therefore be designed accordingly.

BRIEF DESCRIPTION OF THE DRAWING

Above mentioned and other features and objects of the present invention will clearly appear from the following detailed description of embodiments of the invention taken in conjuction with the drawings, where.

DESCRIPTION OF THE PREFERRED EMBODIMENT

Figure 1:
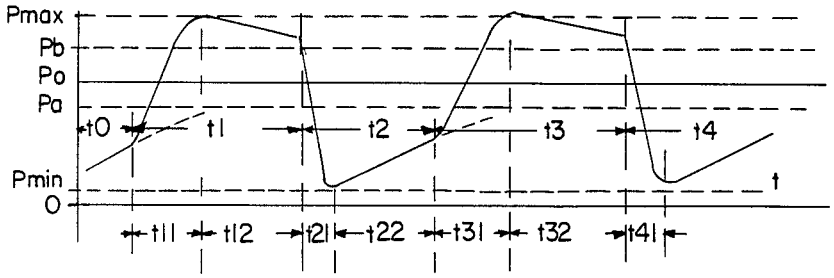
FIG. 1 is a graph which indicates the internal pressure in a power cable due to load cycling.

FIG. 1 indicates the internal load cycling pressures which may occur in a typical mass-impregnated cable. Two cycles are shown (t1, t2 and t3, t4). The cable is installed at a sea depth where the outer water pressure is P0. With no load the internal pressure would increase to a value Pa which depends on the cable design and the conditions at site (ambient temperature, whether the cable is buried or not, thermal resistivity of the soil in the sea bed and so on). During the time t1 the cable is loaded with a certain current. The main heating of the cable takes place during the time t1 up to the maximum temperature which is then practically constant during the time t12. During the heating period the internal pressure increases rapidly up to Pmax—due to rapid expansion of the cable components under the lead sheath (mainly the impregnating compound). During the time t12 the lead sheath will still expand since the internal pressure is higher than the outer water pressure. Therefore the internal pressure would fall to the pressure Pb. When the load is switched off the cable cools down during the time t21 practically to the ambient temperature. Due to rapid cooling the cable components under the lead sheath will contract and consequently the internal pressure falls down to Pmin. Then the pressure would increase up to Pa due to the outer water pressure P0, even if the cable is still cold. At the end of the time period t22 the load is switched on again starting the period t3 and so forth. To recapitulate: The load is on during the times t1 and t3 and the load is off during the time t0, t2 and t4.

The amplitudes Pmax and Pmin of the cyclic internal pressure depend on cable design, sea depth, conductor current, the time of the cycles etc. The internal pressures Pa and Pb represent respectively a stable no load condition and a stable load condition.

The minimum pressure occurs near the end of the cooling periods t21, t41. This is the situation which will be critical if the cable is installed at smaller depths, and the outside water pressure is not large enough to compensate for the low internal pressure. In such cases the minimum pressure may be below the atmospheric pressure, i.e. Pmin<0, and voids will then be created in the insulation.

Figure 2:
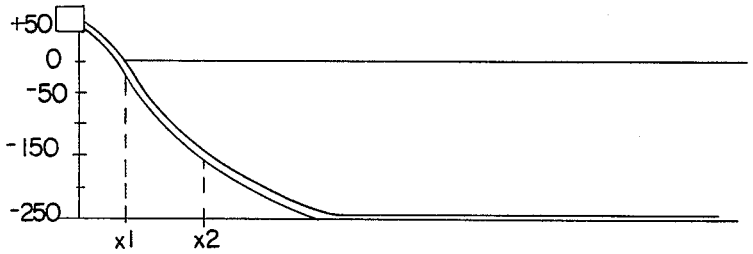
FIG. 2 is a graphical illustration of the profile of a possible cable route.

FIG. 2 shows the profile of a possible route of a cable with one cable terminal being 50 m above the sea level. From 0 to a distance $x_1$ from the terminal the cable is on land. At a distance $x_2$ from the terminal the cable is lying at a depth of 150 m. and the route follows by way of example a slope down to 250 m.

Figure 3:
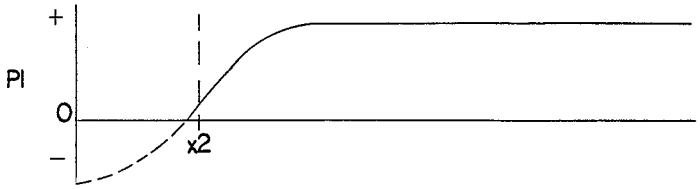
FIG. 3 is a graph which indicates the minimum internal pressure along the cable route, in the cable without the pressure body.

FIG. 3 indicates in principle the minimum internal pressure P1 of the cable (in FIG. 2) during operation a short time after a load has been switched off, for a cable which is not furnished with a pressure body. The dashed part of the curve indicates negative internal pressure (i.e. vacuum) in the cable at sea depths less than 150 m, as an example.

Figure 4:
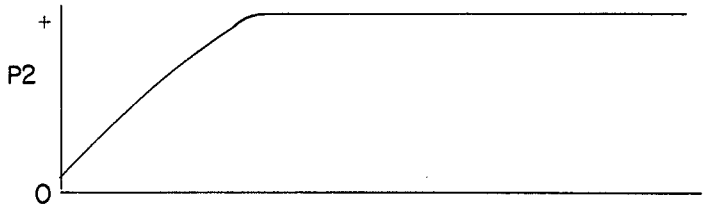
FIG. 4 is a graph which indicates the minimal internal pressure in the cable with a uniform pressure body.

FIG. 4 shows the minimum internal pressure P2 of the cable if it is furnished with the pressure body of the present invention. This pressure is calculated to obtain a positive minimum pressure of the insulation under all load conditions.

Figure 5:
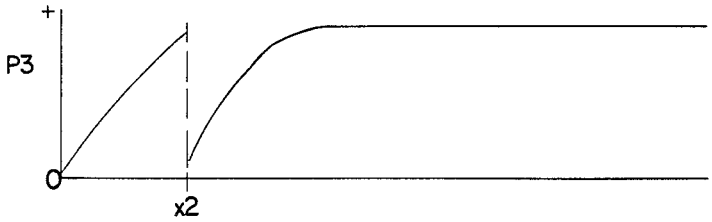
FIG. 5 is a graph which indicates the minimal internal pressure in the cable provided with a non-uniform pressure body.

FIG. 5 shows the minimum internal pressure P3 of the cable when only the part of the cable laid at sea depths less than 150 m is furnished with a pressure body, while the part of the cable which is laid at greater depths is without any pressure body.

It will also be possible to make a submarine cable having a pressure body which is graded in accordance with the conditions of the cable route. The number of pressure tapes and their tension may be varied during the manufacturing process. The transfer from one pressure body to another may be secured by gradual changes or by making changes stepwise. In the area of change, pressure tapes may for instance be locked together by epoxy or the like.

Figure 6:
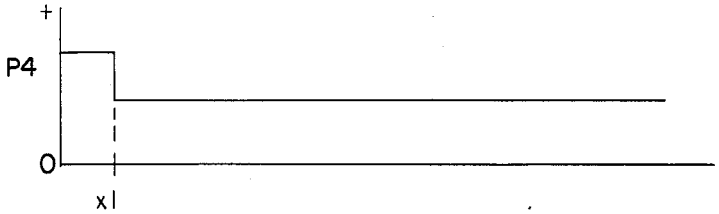
FIG. 6 is a graph which shows the increase in internal pressure due to the load of the cable, FIG. 7 schematically illustrates the cros section of a cable surface which is subjected to water pressure.

FIG. 6 indicates the increase of the internal pressure P4 due to the load of the cable. In this case the part of the cable on land (lying in a trench) has got a higher temperature than that of the cable lying in the sea due to poorer heat dissipation.

Figure 7:
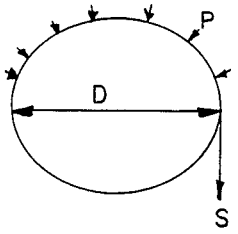

In FIG. 7 is schematically illustrated a cross section of a cable surface which is subjected to a water pressure of P bar. With the water pressure removed as is the case when the cable is laid on land and in very shallow water, an internal pressure of P bar may be obtained by applying suitable pressure tapes with a tension S around the cable surface at a diameter D, neglecting the stiffness of the lead sheath and bedding. (In reality S is the component of the tension perpendicular to the cable axis, but this is little different from the tension of the pressure tapes when the length of lay of the tapes is short.)

Let us assume that the minimum temperature during service is plus 10° (in the ground and/or in shallow waters). Let us further assume that a pressure body in the form of tapes are applied at 20° C. in the factory, and for the sake of simplicity that the cable is lead sheathed and circular (calculations of an oval cable are more complicated than that of a round cable). Further we assume with reference to FIG. 1 that pressure tests in water have shown that a water pressure of 15 bar—i.e. sea depth of 150 m—will be necessary to obtain a positive internal pressure of the insulation under all load conditions.

If we now assume that the diameter at which the pressure tapes are applied is 7.5 cm, the basic component of the tension of the pressure tapes perpendicular to the cable axis will have to be $$S1 = \frac{P \cdot D}{2} = \frac{15 \cdot 7.5}{2} = 56.25 \text{ kp per cm cable} \quad (1)$$

Figure 8:
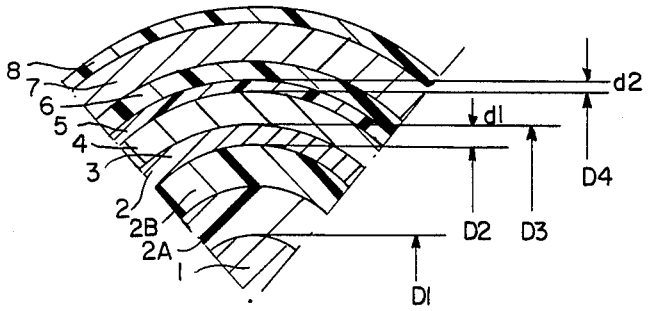
FIG. 8 illustrates the cross section of one embodiment of the invention, and FIGS. 9 and 10 schematically show a cable provided with preferred pressure bodies.

In FIG. 8 is schematically illustrated a partial cross section of a mass impregnated power cable provided with a pressure body. The figure shows a multiwire conductor 1 with diameter D1 provided with layers of impregnated lapped paper insulation 2 with diameter D2, a metal (lead) sheath 3 with diameter D3, a bedding 4 with diameter D4, pressure body 5 in the form of layers 9 and 10 of pressure tapes, as well as corrosion protection layers 6 and 8 and armoring 7. The thickness of the lead sheath 3 is d1, whereas the thickness of the pressure body 5 is d2. The bedding 4 and/or the protection layer 6 may consist of a plastic jacket. The armor may e.g. be heavy steel wire in one or two layers, lighter steel tape applied in a desired number of layers, light weight synthetic Kevlar fibers or other configurations. The usual screens on the conductor and on the insulation are not shown.

Figure 9:
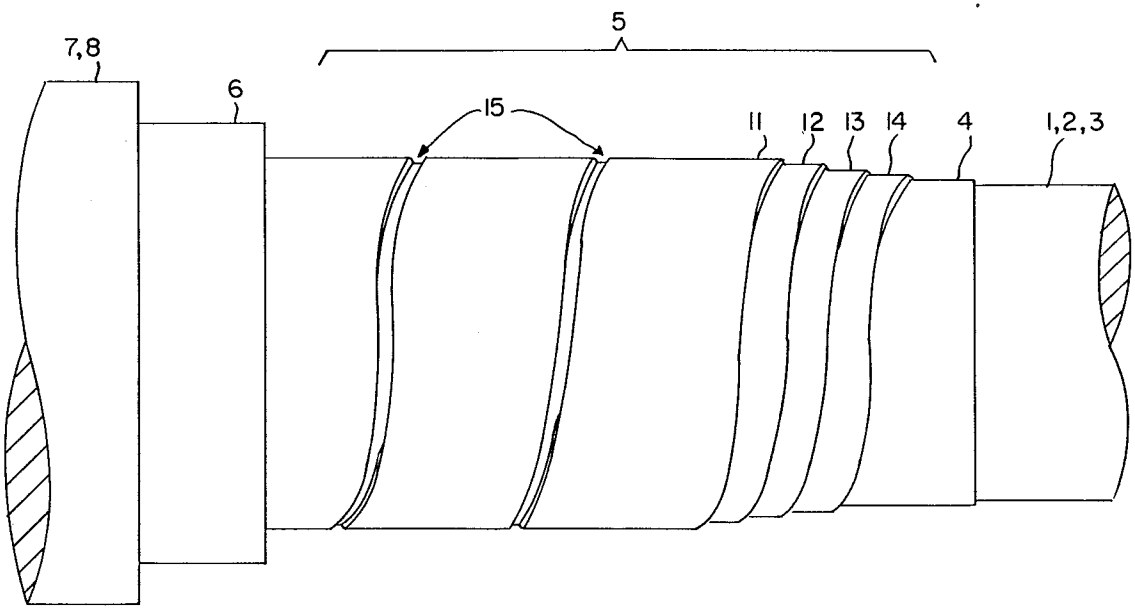

FIG. 9 schematically shows a cable core 1, 2, 3 with the pressure body 5 applied over a bedding 4, in more detail, the pressure body in this case consisting of four layers of pressure tapes 11, 12, 13, 14. As illustrated, the tapes are helically wound with a relatively short length of lay not exceeding 1.5 times the diameter of the lead sheath. The lay length should preferably be 0.4–0.8 times the diameter of the lead sheath. The tapes 11, 12, 13, 14 should have a width of at least 20 mm but not more than 100 mm and there should be positive gaps 15 of 0.2–2.0 mm between the side edges of the tape(s) in each layer. As shown there is only one tape in each layer. Depending upon the width of the tapes there should be maximum two tapes in each layer.

Equation 1 shows the tension at which the tapes in our example should be applied if they had been applied at 10° C. Since they are applied at 20° C., the tension must be increased due to the expansion of the conductor, paper, impregnant and lead sheath when the temperature increases from 10° to 20° C.

The volume of these materials for a unity length of cable are:

$V1=\pi/4D1^2f$=volume of conductor (i.e. the conductor cross-section).

$V2=\pi/4D1^2(1-f)$=volume of the impregnating compound in the interstices between the wires of the conductor.

$V3=\pi/4(D2^2-D1^2)k$=volume of the impregnant in the paper insulation.

$V4=\pi/4(D2^2-D1^2)(1-k)$=volume of the paper fibres.

$V5=\pi/4(D3^2-D2^2)$=volume of the lead sheath.

$V6=\pi/4(D4^2-D3^2)$=volume of the material between the lead sheath and the pressure tapes (e.g. a plastic jacket on the lead sheath) where:

D1 is the diameter of the conductor, "f" is a factor expressing the compactness of the conductor, D2 is the diameter under the lead sheath, "k" is a factor expressing the porosity of the paper, D3 is the outer diameter of the lead sheath and D4 is the diameter above the material between the lead sheath and the pressure tapes. This diameter will generally be taken into account only if this material consists of a plastic jacket.

If the insulation consists of cellulosic paper laminated with a film of synthetic material, this must be taken into account. For the present example, it is assumed that the insulation only consists of impregnated cellulosic paper.

The total expansion of the materials under the pressure tapes can now be expressed by:

$$\begin{aligned} dV &= dV1 + dV2 + dV3 + dV4 + dV5 + dV6 \\ &= dT(a1 \cdot V1 + a2 \cdot V2 + a2 \cdot V3 \cdot V4 + a4 \cdot V5 + a5 \cdot V6) \end{aligned} \quad (2)$$

where a1, a2, a3, a4 and a5 are the expansion coefficients of copper, impregnant, paper fibres, lead sheath and plastic jacket respectively, and $dT=20-10=10°$ C. in our example.

Some calculations of our example (FIG. 8) where the pressure tapes are applied on a thin bedding (neglecting the expansion of the bedding), give as a result that $dV=0.1205$ cm$^3$/cm cable in a cable with certain actual dimensions.

Since the compressibility of these materials can be neglected, the increase of the volume will increase the diameter under the pressure tapes and thereby elongate the pressure tapes by $e1=0.00135$.

The pressure tapes will, however, also expand due to the temperature increase, thereby to some degree relieving the tension which is created in the pressure tapes due to the expansion of the materials under the tapes. In our example this counts for an elongation of: $e2=0.00012$ (if the tape material is steel), and the resulting elongation which will stress the pressure tapes when the temperature is increased from 10° C. to 20° C. will be $e3=e1-e2=0.00123$.

According to Hooke's Law the tension of the pressure tapes will then be:

$$S2=e3 \cdot E \cdot d2 \quad (3)$$

E being the elasticity modulus and d2 the total thickness of the pressure tapes. Assuming d2=1 mm and the material being steel, S2 will be 258 kp/cm. When the tension S1=56 (equation 1) the tension S with which the pressure tapes should be applied to the cable will now be $$S=S1+S2=314 \text{ kp per cm cable.} \quad (4)$$

This is the total tension at which the pressure tapes should be applied, i.e. if the pressure body consists of four tapes, with the same thickness, each tape will be applied with a tension of approximately 105 kp/cm cable. Three of the tapes make up the required tension and the forth tape is spare.

During service the tapes will be exposed to additional tensions, partly due to the level difference of the cable route (static internal pressure of the impregnant which will try to press out the lead sheath) and partly due to the load of the cable which will increase the temperature and thereby expand the materials under the lead sheath.

If for instance the cable route slopes by 50 m from the terminal on land down to the sea level, an additional static pressure of 4.5 bar will contribute to increase the tension of the pressure tapes (if the density of the impregnant is 0.9 g/cm$^3$). In our example the tension will increase by $$S3 = \frac{4{,}5 \cdot D2}{2} = 15 \text{ kp/cm cable} \quad (5)$$

The corresponding elongation of the pressure tapes will be $e4=0{,}00038$.

In the sea the water pressure will to some degree contribute to relieving the tension of the pressure tapes as the depth increases, since the density of water is higher than that of the impregnant.

If we assume that the maximum temperature T1 of the conductor in our example is 50° C. during operation of the temperature T0 at which the pressure tapes were applied is 20° C., we may calculate the expansion dV' confer equation 2) of the materials under the pressure tapes.

The expression for the conductor and the impregnant in the conductor are calculated as above, though with $$dT = T1 - T0(50°-20°) \quad (6)$$

these will be $$dV1' = a1 \cdot dT \cdot V1 \quad (7)$$

$$dV2' = a2 \cdot dT \cdot V2. \quad (8)$$

Since the temperature drops over the insulation (from conductor to lead sheath), the expressions for dV3' and dV4' (impregnant and cellulose fibres in the insulation respectively) will be some more complicated. The following expressions have been developed:

$$dV3' = a2 \cdot dT \cdot V3 - \quad (9)$$

$$\tfrac{1}{8} \cdot k \cdot a2 \cdot rT \cdot L \cdot \left( D2^2 \cdot \ln \frac{D2}{D1} - \tfrac{1}{2} \cdot (D2^2 - D1^2) \right)$$

and $$dV4' = dV3' \cdot \frac{(1-k) \cdot a3}{k \cdot a2} \quad (10)$$

where rT is the thermal resistivity of the insulation material and L represents the losses of the conductor ($L = I^2 \cdot R$, where I is the current and R the electrical resistance of the conductor). In our example $rT = 5°$ $C.m/w$ and L=25 Watts/meter.

Further we have for the expansion of the lead sheath:

$$dV5' = a4 \cdot dT'' \cdot V5 \quad (11)$$

where $dT'' = T2 - T0$ and $T_2$ is given by $$T2 = T1 - \frac{rT \cdot L}{2n} \cdot \ln \frac{D2}{D1} \quad (12)$$

The total expansion of the materials under the pressure tapes will in this case be (neglecting the expansion of the bedding):

$$dV' = 0.237 \text{ cm}^3/\text{cm cable}, \quad (13)$$

and this will give an additional elongation of the tapes by e5=0.00264. The expansion of the pressure tapes is calculated to e6=0.00015, so that the net corresponding additional expansion will be $e7 = e5 - e6 = 000249$ and the tension (S4) of the pressure (steel) tapes will be about $$S4 = 523 \ kp/cm. \quad (14)$$

In our example the total tension of the tapes will then be:

$$S = S1 + S2 + S3 + S4 = 852 \ kp/cm \quad (15)$$

and the total elongation of the pressure tapes will be $$e8 = 0.0041. \quad (16)$$

If the minimum temperature of the cable in service is 20° C. the tape tension during application may be reduced considerably. However, when the minimum temperature is 20° C. or higher, a maximum temperature of 60° C. may be allowed, and therefore S4 will increase correspondingly. Otherwise the maximum allowable temperature may be in excess of the 50° C. respectively 60° C. for this new cable type, since it will always operate with a pressure of the insulation above the atmospheric pressure and no migration will take place. The elongations and tensions of the pressure tapes will increase correspondingly.

If a material with a lower elasticity modulus is used, the tension due to the expansions of the cable (T2 and T4) will be lower, but the values of the elongations due to temperature increases will be practically the same.

It is evident that pressure tape material must have very good elasticity properties. The requirement to the elastic elongation (and the elastic limit) of the material will depend on the cable size and the condition during service. Some calculations show that in certain cases the elongations of the pressure tapes may be as slow as 0.003 and in other cases as high as 0.009 or even more.

The calculations of temperature expansion show that it is a great advantage to use an insulating paper with high density, i.e. low value of "k". This is due to the fact that the expansion coefficient of the impregnant (a2) is about 4.7 times as that of the paper fibres (a3). In the above example the expansion of the impregnant counts for about 60 percent of the total expansion (sum of the expansions of conductor, impregnant, paper fibres and metal sheath) the paper density being 1 g/cm$^3$. It is considered that it is a great advantage with regard to the expansion to use paper with even higher densities.

Materials which will meet the requirements are high quality steel having an elastic limit of at least 6500 kp/cm$^2$, high quality bronze having an elastic limit of at least 3500 Kp/cm$^2$.

However, this invention covers all materials—including synthetic materials such as glass fiber armored epoxy, polaymid armored with glass, Kevlar or carbon and so on—which have elasticity properties which are satisfactory in the sense of being used as a pressure body for mass-impregnated pressure cables.

Any number of tapes may be used if they satisfy the requirements with regard to the calculated tensions and elastic elongation. However, it is preferred to use at least 4 layers of tapes with a maximum of two tapes in each layer, though from a practical manufacturing point of view the number of layers of tapes should be limited to 8.

It is necessary to keep the tension of the pressure tapes within the elastic limit all the time and pressure tapes must be dimensioned accordingly. The pressure tapes are applied on a thin layer of some material acting as a bedding (for instance one layer of copper woven fabric tape). Alternatively the tapes may be applied over a plastic jacket which is usually applied on the lead sheath during the manufacture, but also in this case a thin bedding should be applied under the pressure tapes.

In order to reduce the risk of cracks of the lead sheath or the plastic sheath at the edges of the pressure tapes, at least the inner tape which is applied directly on the bedding, should be thin (preferably not more than 0.25 mm thick). Otherwise it is obvious that the total thickness and number of tapes must be calculated to withstand the sum of the tensions which arises during application and during service of the cable and the elongation of the tapes must be within the elastic limit.

Generally it will also be an advantage for safety reasons to divide the total thickness of the pressure body in at least n tapes, the n−1 tapes being sufficient to withstand the tension, the nth tape being spare. During application it will be an advantage with even numbers of tapes due to the balance of the taping head(s). Since the cable may be twisted during manufacture, during laying etc. especially if the cables are armored with one layer of armor wires the tapes may to some degree loosen if they are applied in the same direction as that of the armor wires. Therefore, it is considered to be an advantage to apply the pressue tapes in the opposite direction as that of the armor wires. In other cases it may be an advantage to apply half of the tapes in one direction, and the other half in the opposite direction. On the other hand loosening of the tapes due to possible twisting may in several cases by counteracted by increasing to a certain degree the tension of the pressure tapes during the application of the tapes.

Figure 10:
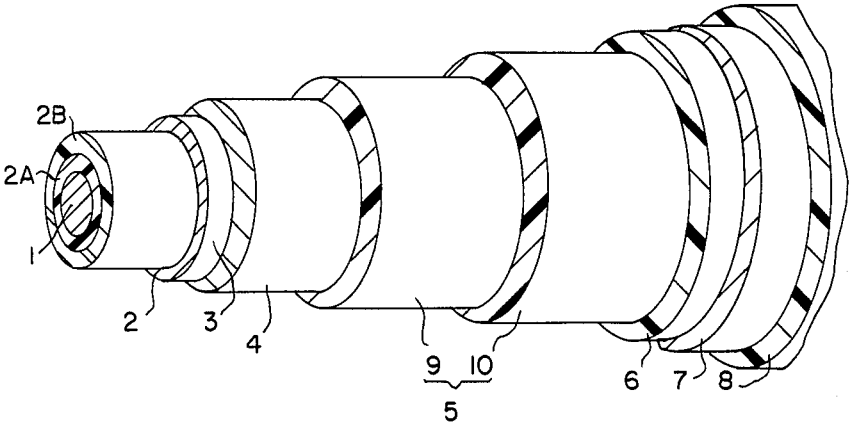

The above detailed description of embodiments of this invention must be taken as examples only and should not be considered as limitations on the scope of protection. This is true in particular with regard to the use of pressure tapes as the unique pressure body of the present invention. An example of a pressure body which may be used is schematically illustrated in FIG. 10, where sets of pressure tapes 9 and 10 are shown. Each of the sets 9 and 10 comprises several layers of pressure tapes, one set 9 being wound in one direction on the bedding 4 and the other set 10 being wound in the other direction directly on the first set 9.

What is claimed is:

1. A mass-impregnated power cable of circular cross section comprising:

a single core conductor for transmitting high voltage direct current power;

a plurality of mass-impregnated insulating tapes surrounding and positioned on said conductor;

a sheath of circular cross section surrounding and positioned on said insulating tapes;

a layer of a bedding material surrounding and positioned on said sheath; and a pressure body surrounding said bedding material layer and including a first layer of an elastic tape helically surrounding said bedding material layer and a second layer of an elastic tape helically surrounding said first layer, each of said elastic tapes having longitudinal side edges and a predetermined width and being positioned such that one side edge of the tape is spaced a predetermined distance from the side edge of the adjacent helical turn of the tape, each of said tapes having a length of lay equal to or less than 1.5 times the diameter of said sheath.

2. The power cable of claim 1 wherein said first tape layer has a thickness of not more than 0.25 mm.

3. The power cable of claim 2 wherein the length of lay of each of said elastic tapes is less than the cable diameter.

4. The power cable according to claim 1 wherein each of said elastic tapes is formed of a material having an elastic elongation of at least 0.3 percent.

5. The power cable of claim 4 wherein the material has an elastic elongation of 0.4–0.9 percent.

6. The power cable according to claim 1 further comprising an armoring layer surrounding said pressure body, said armoring layer including a plurality of flexible elongated members wound in a direction opposite to that of said elastic tapes, said flexible elongated members consisting of one of tapes and wires.

7. The power cable according to claim 1 wherein said pressure body includes additional layers of elastic tapes.

8. The power cable according to claim 7 wherein said elastic tape layers are even in number, one half being applied helically in one direction and the other half being applied helically in the opposite direction.

9. The power cable of claim 1 wherein each of said elastic tapes is formed of a material selected from the group of materials consisting of a metallic material and a synthetic material.

10. The power cable of claim 1 wherein said bedding layer includes either one of a copper woven fabric tape or a plastic jacket.

11. The power cable according to claim 1 wherein said predetermined width is in the range of 20 mm—100 mm.

12. The power cable according to claim 1 wherein said predetermined space is in the range of 0.2–2.0 mm.

13. The power cable according to claim 1 wherein each of said layers of elastic tape includes an additional elastic tape.

14. The power cable according to claim 9 wherein said metallic material is selected from the group consisting of high quality galvanized steel, stainless steel with an elastic limit of at least 6500 kp/cm$^2$ and high quality bronze with an elastic limit of at least 3500 kp/cm$^2$.

15. The power cable of claim 6 further comprising a first corrosion protection layer positioned between said pressure body and said armoring layer and a second corrosion protection layer positioned on the outer surface of said armoring layer.

16. A high voltage mass-impregnated power cable of circular cross section to follow a predetermined cable route on land and/or on a sea bed for transferring power at voltages above 250 KV DC, comprising:

an elongated single core conductor for transmitting direct current power at a voltage above 250 KV DC;

a plurality of viscous mass-impregnated insulating tapes surrounding and positioned on said conductor;

a fluid tight metal sheath of circular cross section surrounding and positioned on said insulating tapes;

a flexible bedding material layer surrounding and positioned on said sheath;

a pressure body surrounding said bedding material layer and including a first layer of an elastic tape helically surrounding said bedding material layer and a second layer of elastic tapes helically surrounding said first layer, each of said elastic tapes having longitudinal side edges and a predetermined width and being positioned such that one side edge of the elastic tape is spaced a predetermined distance of between 0.2 and 2.0 mm from the side edge of the adjacent helical turn of the elastic tape, each of said elastic tapes having a length of lay equal to or less than 1.5 times the diameter of said sheath and a width which is at least 20 mm and not nore than 100 mm, the number of elastic tapes in each of said first and second layers being no greater than two; and an external armoring surrounding said pressure body.

17. A cable as in claim 16, wherein said insulating tapes include cellulose paper tapes having a high density and impregnated with a viscous mass, said elastic tapes being formed of one of metal and synthetic material, said bedding material layer being formed of a material selected from the group consisting of woven copper layers and plastic sheath.

18. The cable according to claim 3 wherein the length of lay of each of said elastic tapes is in the range of 0.4 to 0.8 times the diameter of said sheath.

19. The cable according to claim 1, wherein said mass-impregnated insulating tapes are impregnated with a viscous compound.

* * * * *